US005952788A

United States Patent [19]

Graham et al.

[11] Patent Number: 5,952,788

[45] **Date of Patent: *Sep. 14, 1999**

[54] VACUUM FLUORESCENT DISPLAY FILAMENT DRIVE CIRCUIT

[75] Inventors: Donald W. Graham, Grand Haven; Stephen S. Otzman, Spring Lake, both of Mich.

[73] Assignee: Robertshaw Controls Company, Richmond, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/617,173

[22] Filed: Mar. 18, 1996

[51] Int. Cl.[6] ..... H05B 37/02

[52] U.S. Cl. ..... 315/105; 315/169.1

[58] Field of Search ..... 315/169.1, 209 R, 315/101, 105, 106, 107, 97

[56] References Cited

U.S. PATENT DOCUMENTS

| | | | |
|---|---|---|---|
| 2,855,544 | 10/1958 | Germeshausen . | |
| 3,656,142 | 4/1972 | Tatsuta | 315/209 R |
| 4,158,794 | 6/1979 | Sandler . | |
| 4,237,403 | 12/1980 | Davis | 315/105 |
| 4,241,294 | 12/1980 | Fisler . | |
| 4,495,445 | 1/1985 | Turney . | |
| 5,075,602 | 12/1991 | Overgoor et al. | 315/209 R |
| 5,349,269 | 9/1994 | Kimball . | |
| 5,365,146 | 11/1994 | Kadwell . | |
| 5,402,042 | 3/1995 | Madsen . | |
| 5,424,614 | 6/1995 | Maheshwari . | |
| 5,442,259 | 8/1995 | Lameris et al. . | |

*Primary Examiner*—Michael B Shingleton
*Attorney, Agent, or Firm*—Terrence Martin; Jules J. Morris; Sean D. Detweiler

[57] ABSTRACT

A drive circuit for controlling a vacuum fluorescent display is provided. A charge storage device is connected between signal ground or a voltage supply and a display element. One multiway switch or two single-position switches are connected to the display element opposite the charge storage device. In either configuration, the switch or switches are controlled by an oscillator which, by toggling the switch or switches, alternates the configuration of the circuit to charge or discharge the charge storage device through the display element. The charge storage device and the display element may be connected to a regulated voltage which is maintained at a potential above the grid voltage to reduce cross-talk in the display. The switching operation is break before make and produces an AC voltage across the display element.

23 Claims, 2 Drawing Sheets

VACUUM FLUORESCENT DISPLAY FILAMENT DRIVE CIRCUIT

BACKGROUND OF THE INVENTION

1. Field of the Invention

The present invention generally relates to vacuum filament displays and more particularly to a drive circuit for a vacuum filament display.

2. Description of the Related Technology

It is known in the prior art to provide a control device with a microcomputer unit, a vacuum fluorescent display having a filament, a set frequency power supply interconnected to a high voltage alternating current power supply, and connecting circuit, as shown in U.S. Pat. No. 5,365,146, the disclosure of which is expressly incorporated by reference herein. The arrangement includes a power supply creating a low voltage direct current to power the microcomputer unit, the filament is connected to a capacitor so that a direct current is pulsed through the filament at the same frequency as the certain frequency of the high voltage alternating current power supply (50–60 Hz) so as to heat the filament to an operating temperature.

It is also known to utilize a pair of transistors each having a base emitter junction and connected in parallel together with an oscillator transistor connected between the base emitter junctions of the transistors and one side of the capacitor so that the oscillator transistor will cause the transistors to be turned off and on at a certain frequency to provide an oscillator unit.

It is also known in the prior art to provide a control device with a microcomputer unit, a vacuum fluorescent display having a filament, a power supply interconnected to a high voltage alternating current power supply that has a certain frequency, and a circuit operatively interconnecting the elements together. The power supply includes a transformerless capacitor arrangement for creating a low voltage direct current from the power supply to power the microcomputer, the circuitry including an oscillator that receives the pulses direct current through the filament at a frequency that is greater than the certain frequency and that causes the filament to heat to an operating temperature.

It is also known to utilize a secondary winding on a transformer to drive a vacuum filament display.

SUMMARY OF THE INVENTION

It is an object of the invention to eliminate the need for an additional secondary winding on a transformer. The circuit of Applicant's invention utilizes an oscillator control to operatively control either a first and second opening and closing switch or a single multiway switch whereby a capacitor is alternatively charged and discharged through a vacuum filament display. A voltage source first charges a capacitor through the filament of a vacuum fluorescent display. When the capacitor has charged to a desired voltage, the oscillator control opens the closed switch and closes the open switch thereby discharging the capacitor through the filament of the vacuum fluorescent display. Advantageously, the switches are in a break before make arrangement. In an alternative configuration, the oscillator control changes the position of a single multiway switch thereby discharging the capacitor through the filament of the vacuum fluorescent display. In either configuration, the cycle operates continuously, thereby producing an AC voltage across the filament of the vacuum fluorescent display.

One embodiment of the present invention is directed to a vacuum fluorescent display drive circuit including a vacuum fluorescent display, a capacitor, a voltage supply, a pair of opening and closing switches (break before make), and an oscillator based control connected to the switches, the oscillator control first opens one switch and then closes the other switch so as to alternate the capacitor between a charge and discharge state with the vacuum fluorescent display in order to present an alternating current to the display.

It is still a further object of the invention that an alternative embodiment utilizing a single multiway switch rather than a pair of opening and closing switches be provided. In this embodiment, the oscillator control cycles the multiway switch so as to alternate the capacitor between a charge and discharge state with the vacuum fluorescent display in order to present an alternating current to the display.

It is still a further object of the invention that the oscillator control operate at a frequency above the audio range thereby preventing an audible output from the display bottle.

It is yet another object of the invention that the vacuum fluorescent display drive circuit eliminate the necessity of an additional winding on a transformer used to drive a vacuum fluorescent display.

It is still a further object of this invention to provide a vacuum fluorescent display control circuit which reduces the occurrence of cross-talk or ghosting, thereby extending the life of the vacuum fluorescent display.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENTS

Figure 1:
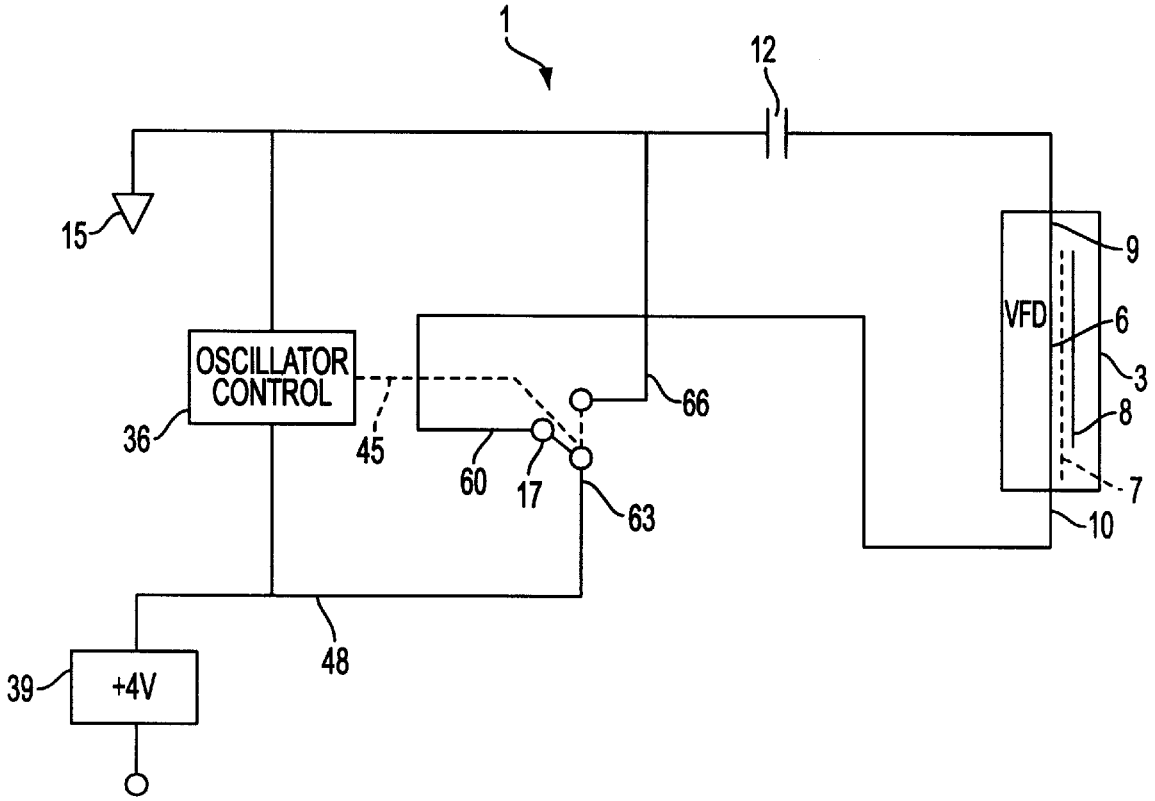
FIG. 1 is a schematic circuit diagram of one embodiment of the vacuum fluorescent display control circuit.

Referring now to the drawings, in FIG. 1 a vacuum filament display drive circuit is generally indicated by the reference numeral 1.

A vacuum filament display 3 is provided. The vacuum filament display 3 is conventional in the art and as illustrated in FIG. 1 comprises a filament 6 that when heated by an electrical current will emit electrons that pass through a grid plate 7 and collide with fluorescent material of anode segments 8 exciting the same into luminescence. The filament 6 has a first end 9 and a second end 10. The first end of the filament 6 is connected to a capacitor 12. In the preferred embodiment, the capacitor 12 is a high ripple, high voltage, non-polarized capacitor. The exact value of the capacitance is not critical. Those of ordinary skill in the art will be able to select an appropriate capacitor based on the operating characteristics of the display components. The capacitor 12 is connected between the first end 9 of the filament means 6 and a signal ground 15. Although the values of certain components will be described herein, most of the components illustrated are well known in the art, and thus only the components which are necessary to understand the unique features of the vacuum filament display drive circuit 1 will be set forth in detail. Those of ordinary skill in the art will be able to establish component values base on component choices and characteristics.

In the embodiment illustrated in FIG. 1, a multiway switch 17 having a first connection 60, a second connection 63 and a third connection 66 is provided. The first connection 60 is connected to the second end 10 of the filament 6, while the second connection 63 is connected to a voltage supply 39 and the third connection 66 is connected to the signal ground 15.

Figure 2:
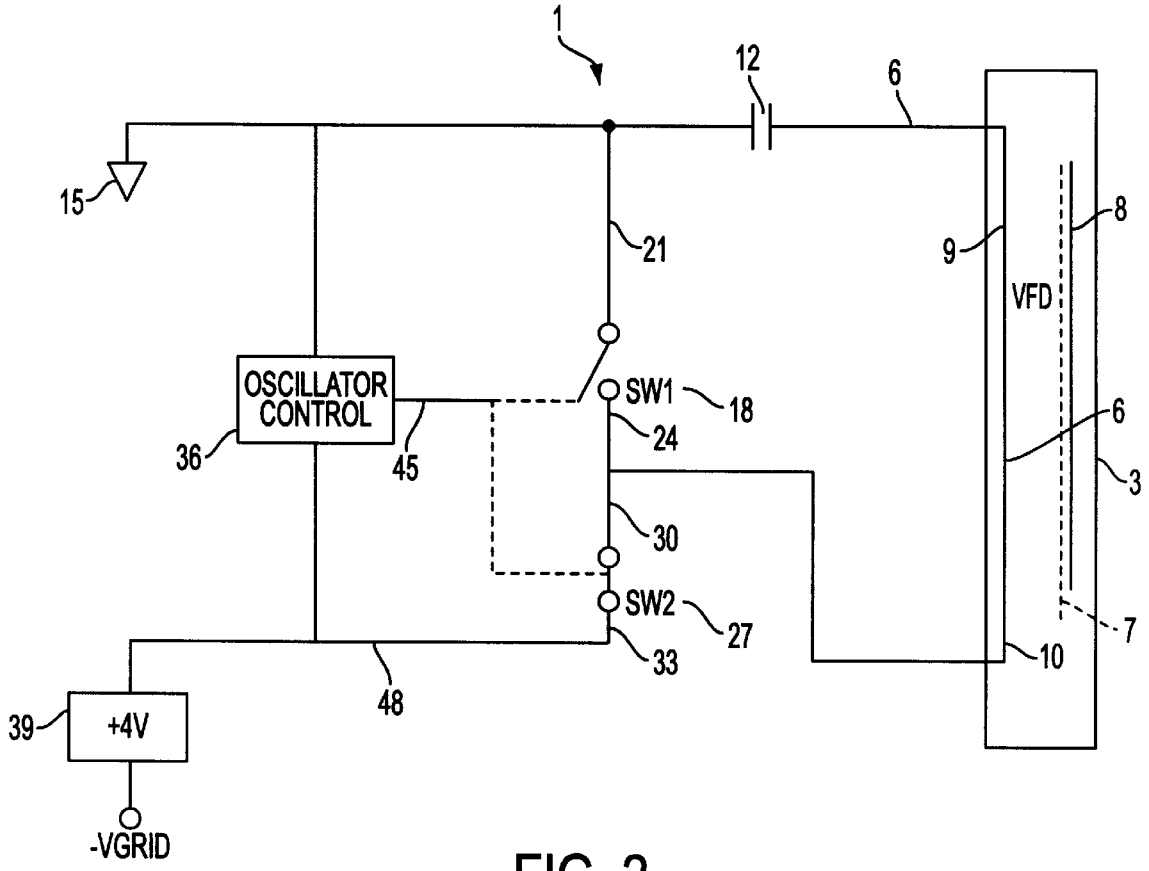
FIG. 2 is a schematic circuit diagram of another embodiment of the vacuum fluorescent display control circuit.

In the embodiment shown in FIG. 2, a first switch 18 has first and second switch points 21 and 24 respectively, and a second switch 27 has first and second switch points 30 and 33 respectively. The first connection 21 of the first switch 18 is connected to the signal ground 15. The second connection 24 of the first switch 18 is connected to the second end 10 of the filament 6 and the first connection 30 of the second switch 27. The second connection 33 of the second switch 27 is connected to a voltage supply 39.

In either of the configurations of FIGS. 1 or 2, the voltage supply 39 may advantageously be a regulated voltage (VREG), 4 volts above a grid voltage (VGRID).

The regulated 4 volt differential above VGRID serves to alleviate cross-talk or ghosting in the display of the vacuum fluorescent display 3.

An oscillator control 36 is provided. The oscillator control 36 is connected between the voltage supply 39 and the signal ground 15 and has an output 45 connected to drive the first switch 18 and the second switch 27 in the embodiment shown in FIG. 2 or the multiway switch 17 in the embodiment of FIG. 1. The oscillator control 36 may be any circuit which provides an appropriate alternating control signal. The oscillator control may be driven by a crystal oscillator, a microprocessor, a clock, or other oscillating circuit element. The oscillator control 36 is railed between signal ground 15 and +4VDC above VGRID and thereby serves to control the first switch 18 and the second switch 27 in the embodiment shown in FIG. 2 or the multiway switch 17 in the embodiment of FIG. 1.

The oscillator control 36 advantageously operates at approximately 22 Kilohertz, or approximately 2 Kilohertz above the audio range. A frequency above the audio range is chosen because the application of an AC signal within the audio range to the filament means 6 creates an audio output from the display. The operation of the oscillator control 36 at a frequency above the audio range prevents the filament from resonating in the audio range.

In operation, the embodiment shown in FIG. 1 works as follows. In operation, the multiway switch 17 is alternatively driven between two states. In one state, multiway switch 17 is positioned so as to connect the first connection 60 and the second connection 63. In this state a charging path is created for the capacitor 12. The charging path is from the power supply 39 through the second connection 63 and first connection 60 of the multiway switch 17 and the display 3 to the capacitor 12. The capacitor 12 is charged to a potential equal to the desired filament voltage (VFIL). In the second state, the oscillator control 36 positions the multiway switch 17 so as to connect the first connection 60 and the third connection 66. The capacitor 12 becomes a potential source for the vacuum filament display 3. The capacitor 12 discharges through the display 3, close switch 18 to ground 15. The previously described cycle is repeated, with the oscillator control 36 continuing to cycle the multiway switch 17 between the second connection 63 and the third connection 66, thereby creating the AC mode also of operation.

In operation, the embodiment shown in FIG. 2 works as follows. The switches 18 and 27 are alternatively opened and closed out of phase with each other in a break before make manner. In one state, second switch 27 is closed and the first switch 18 is open. In this state a charging path is created for the capacitor 12. The charging path is from the power supply 39 through the closed second switch 27 and the display 3 to the capacitor 12. The capacitor 12 is charged to a potential equal to the desired filament voltage (VFIL). In the second state, the oscillator control 36 opens the second switch 27 and closes the first switch 18. The capacitor 12 becomes a potential source for the vacuum filament display 3. The capacitor 12 discharges through the display 3, closed switch 18 to ground 15. In the switching operation herein described, the closed switch is always opened before the open switch is closed. The previously described cycle is repeated, with the oscillator control 36 continuing to first open and then close the respective switches, thereby creating the AC mode of operation.

The circuit 1 thus allows for the AC mode of operating a vacuum filament display without the necessity of an additional secondary winding on a transformer previously utilized to operate the vacuum filament display.

The present invention, therefore, is well adapted to carry out the objects and attain the ends and advantages mentioned as well as others inherent therein. While a presently preferred embodiment of the invention has been given for the purpose of illustration, numerous changes in the details of construction, and arrangement of parts, will be readily apparent to those skilled in the art, and which are encompassed within the spirit of the invention and the scope of the appended claims.

What is claimed is:

1. A display drive circuit, comprising:

a display element;

a charge storage device connected between said display element and a signal ground;

a switch directly connected to said display element opposite said charge storage device;

said switch being switchable between a voltage supply and said signal ground;

an oscillator operatively connected to said switch, said signal ground and said voltage supply, whereby said oscillator alternately switches said switch between said signal ground and said voltage supply.

2. The display drive circuit of claim 1, wherein said display comprises a vacuum fluorescent display.

3. The display drive circuit of claim 1, wherein said charge storage device comprises a capacitor.

4. The display drive circuit of claim 1, wherein said voltage supply comprises a grid voltage and a regulated voltage and said regulated voltage is at a positive potential relative to said grid voltage.

5. The display drive circuit of claim 4, wherein said regulated voltage is plus four volts relative to said grid voltage.

6. The display drive circuit of claim 4, wherein said grid voltage provides a cut-off voltage to said display element.

7. The display drive circuit of claim 1, wherein said oscillator is railed between said regulated voltage and said signal ground.

8. The display drive circuit of claim 1, wherein said oscillator operates at approximately 22 Kilohertz.

9. A display drive circuit, comprising:

a display element;

a charge storage device connected between a first end of said display element and a signal ground;

a first switch with a first terminal connected to said signal ground and a second terminal directly connected to a second end of said display element;

a second switch with a third terminal directly connected to said second end of said display element and a fourth terminal connected to a voltage supply with an output voltage greater than a grid voltage of said display element; and an oscillator operatively connected to said first and second switches, and connected to said signal ground and said voltage supply output, whereby said oscillator controls said first and second switches.

10. The display drive circuit of claim 9, wherein said display comprises a vacuum fluorescent display.

11. The display drive circuit of claim 9, wherein said charge storage device comprises a capacitor.

12. The display drive circuit of claim 9, wherein said output voltage is at a positive potential relative to said grid voltage.

13. The display drive circuit of claim 9, wherein said output voltage is four volts greater than said grid voltage.

14. The display drive circuit of claim 12, wherein said grid voltage provides a cut-off voltage to said display.

15. The display drive circuit of claim 9, wherein said oscillator is railed between said output voltage and said signal ground.

16. The display drive circuit of claim 9, wherein said oscillator operates above the audible frequency range.

17. The display drive circuit of claim 16, wherein said oscillator operates at approximately 22 Kilohertz.

18. The display drive circuit of claim 9, wherein said switches are configured in a break-before-make combination.

19. A method for driving a vacuum filament display, comprising the steps of:

providing at least one switch directly connected to a vacuum filament display element;

charging a capacitor through a vacuum filament display element with said directly connected switch;

discharging the capacitor through the vacuum filament display element with said directly connected switch; and alternating the steps of charging and discharging at a predetermined frequency.

20. A method according to claim 19, further comprising the steps of:

generating an oscillating control signal; and alternating the configuration of a switching circuit to control the steps of charging and discharging with said directly connected switch.

21. A method according to claim 20, wherein the predetermined frequency is a frequency above the audible frequency range.

22. A method according to claim 21, wherein said predetermined frequency is 22 to 24 Kilohertz.

23. A method according to claim 22, wherein the step of charging and discharging is performed at a voltage displaced from the grid voltage of the display element.

* * * * *